US006361674B1

(12) United States Patent
Franklin

(10) Patent No.: US 6,361,674 B1
(45) Date of Patent: Mar. 26, 2002

(54) POWERED LIFT FOR ECP CHAMBER

(75) Inventor: Timothy J. Franklin, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/636,449

(22) Filed: Aug. 11, 2000

(51) Int. Cl.[7] ..... C25D 5/00

(52) U.S. Cl. ..... 205/80; 204/198; 204/269; 205/345; 294/119.1

(58) Field of Search ..... 294/119.1; 204/288.3, 204/198, 269; 205/80, 334, 345

(56) References Cited

U.S. PATENT DOCUMENTS 5,901,997 A * 5/1999 Bayer ..... 204/198

6,174,123 B1 * 1/2001 Marttila ..... 204/198

* cited by examiner

*Primary Examiner*—Kathryn Gorgos
*Assistant Examiner*—Thomas H Parsons
(74) *Attorney, Agent, or Firm*—Dugan & Dugan

(57) ABSTRACT

An electrochemical deposition system comprising a fixture adapted to selectively grasp and release an electrochemical process cell is provided. The system may include a lift/lower mechanism coupled to the fixture and adapted to automatically stop lowering the fixture at a process cell elevation, a rotation mechanism coupled to the fixture and adapted to automatically stop rotating the fixture when aligned with a process cell location and when aligned with a process cell exchange location. The fixture adapted to selectively grasp and release an object to be lifted may include a cam/follower coupling between a rotatable portion of the fixture and a gripping portion of the fixture. To grasp a process cell with the fixture, the rotating portion of the fixture may be rotated so as to retract the gripping portion of the fixture causing the gripping portion to close around the process cell.

32 Claims, 6 Drawing Sheets

POWERED LIFT FOR ECP CHAMBER

BACKGROUND OF THE INVENTION

Electrochemical deposition processes employ electrochemical process cells that contain anodes which are expended after a given number of deposition cycles. Electrochemical process cells therefore must be periodically replaced or refurbished. Unfortunately, electrochemical process cells are heavy (e.g., weighing approximately 100 pounds) and, after use are contaminated, having harmful chemicals on their exterior surfaces. As follows, operators of electrochemical deposition systems may be exposed both to heavy loads, and to harmful chemicals during electrochemical process cell replacement. Accordingly, a method and apparatus for facilitating process cell replacement is needed.

SUMMARY

The present invention provides an electrochemical deposition system comprising a fixture adapted to selectively grasp and release an electrochemical process cell, a lift/lower mechanism coupled to the fixture and adapted to automatically stop lowering the fixture at a process cell elevation, a rotation mechanism coupled to the fixture and adapted to automatically stop rotating the fixture when aligned with a process cell location and when aligned with a process cell exchange location. The fixture adapted to selectively grasp and release an object to be lifted may comprise a mounting plate having a plurality of gripper fingers slidably coupled to the mounting plate so that each gripper finger can extend outwardly, and retract inwardly and a rotatable plate rotatably coupled to the mounting plate, and having a plurality of slots, each slot being positioned adjacent one of the plurality of gripper fingers, and each slot having an outer end and an inner end positioned such that the slot extends in the direction the rotatable plate rotates. A plurality of pins may each slidably extend through one of the plurality of slots and couple to one of the gripper fingers. Other such cam/follower couplings between a rotatable portion of the fixture and a gripping portion may be similarly employed. To grasp a process cell with the fixture the rotating portion of the fixture is rotated so as to retract the gripping portion of the fixture causing the gripping portion to close around the process cell.

Other features and aspects of the present invention will become more fully apparent from the following detailed description of the preferred embodiments, the appended claims and the accompanying drawings.

DETAILED DESCRIPTION OF THE INVENTION

Figure 1A:
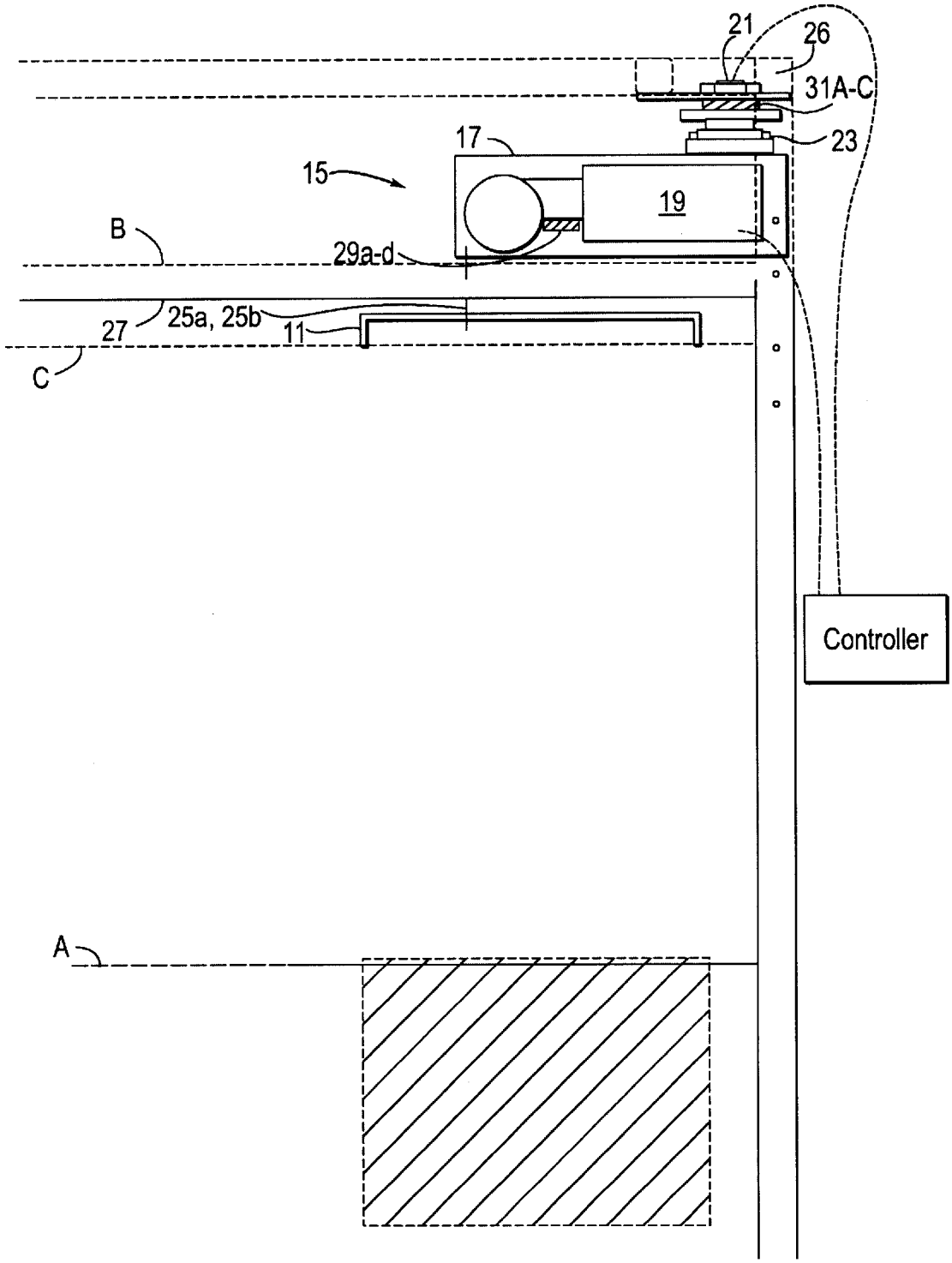
FIGS. 1A and 1B are schematic side views of an inventive electrochemical deposition system, showing a process cell fixture aligned with a process cell location and positioned at a rotation elevation, and showing a process cell fixture aligned with a process cell exchange location, and positioned at a process cell elevation, respectively.
Figure 1B:
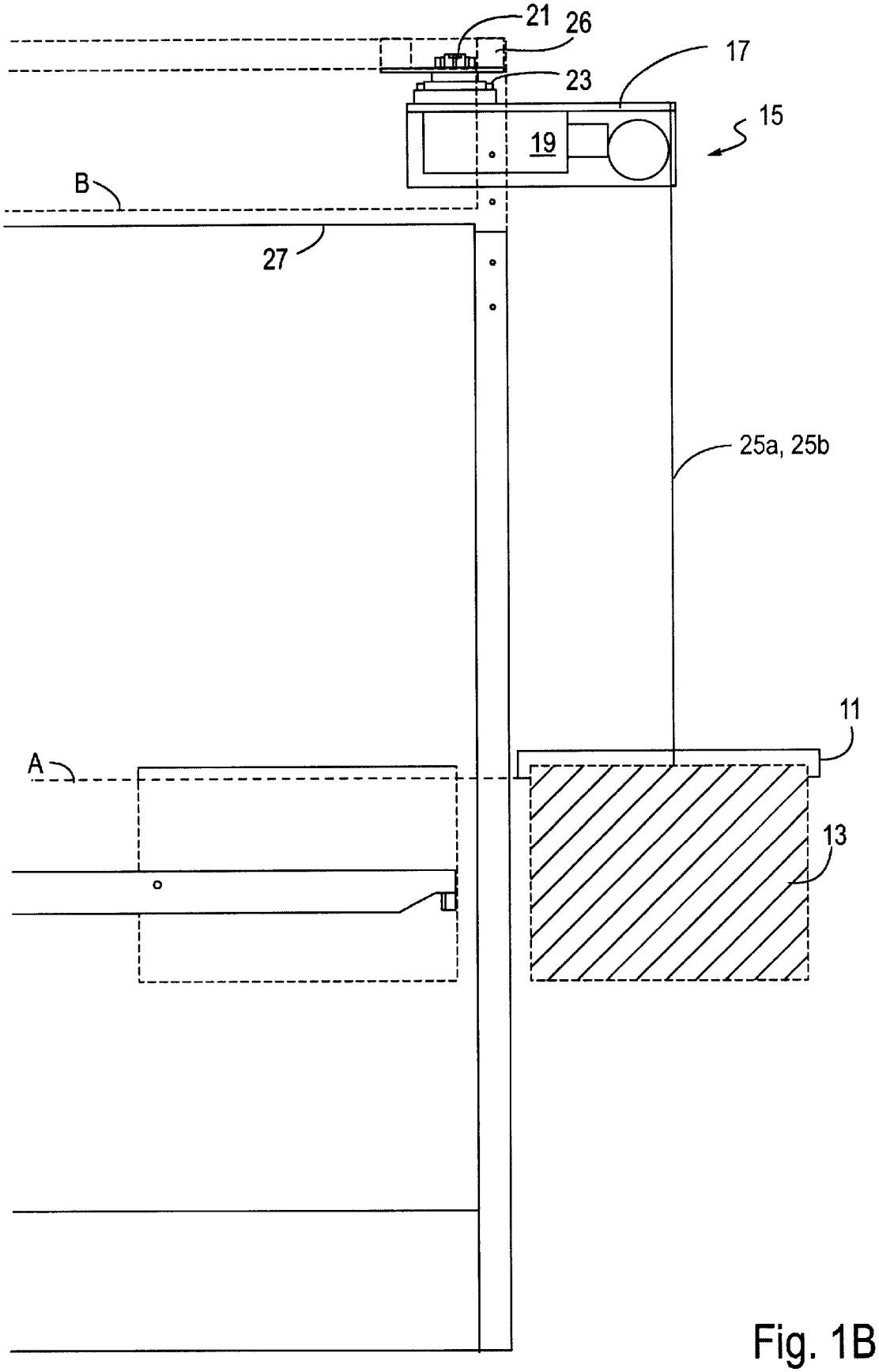

FIGS. 1A and 1B are schematic side views of an inventive electrochemical deposition system, showing a process cell fixture aligned with a process cell location and positioned at a rotation elevation, and showing a process cell fixture aligned with a process cell exchange location, and positioned at a process cell elevation, respectively. FIGS. 1A and 1B are described with joint reference to FIG. 2 which is a schematic top plan view of an inventive electrochemical deposition system showing a fixture support arm in a first process cell location. The inventive electrochemical deposition system comprises a fixture 11 adapted to selectively grasp and release an electrochemical process cell 13, as described in detail with reference to FIGS. 3A–C. Electrochemical process cells are well known in the art and are therefore not described in detail herein. An exemplary electrochemical deposition system including an electrochemical process cell is described in U.S. patent application Ser. No. 09/289,074 titled ELECTRO-CHEMICAL DEPOSITION SYSTEM, filed on Apr. 8, 1999 now U.S. Pat. No. 6,267,853, the entire disclosure of which is incorporated herein by this reference. The inventive electrochemical deposition system further comprises an overhead hoist 15 comprising a support arm 17 having a lift/lower motor 19 mounted thereon, and a rotation motor 21 coupled thereto via a bearing 23. A pair of retractable straps 25*a,* 25*b* are coupled to the fixture 11 and coupled to the motor 19 such that the motor 19 can extend and retract the retractable straps 25*a–b* between a process cell elevation represented by phantom line A and a storage elevation represented by phantom line B. When in the process cell elevation the fixture 11 is able to engage and grasp the process cell 13 as described with reference to FIGS. 3A–3C, and when in the storage elevation the fixture 11 is recessed within a ceiling 27 of the inventive electrochemical deposition processing system, where the fixture 11 is stowed. Circuit breakers may be in place to prevent accidental movement of the fixture 11 when in the storage position. As shown in FIG. 1A, the fixture 11 is positioned at a rotation elevation, represented by phantom line C. when positioned in the rotation elevation C, the fixture 11 is just below the ceiling 27 such that the fixture 11 is free to rotate and the retractable straps 25*a–b* of the fixture 11 are sufficiently short so as to deter swinging of the fixture 11.

A mechanism adapted to stop the fixture 11 at the process cell elevation A, the storage elevation B and the rotation elevation C is coupled to the lift/lower motor 19. Such a mechanism may comprise a plurality of microswitches, one for stopping the lift/lower motor 19 when the fixture 11 reaches each desired elevation (elevations A, B, and C). Suitable microswitches are well known in the art, and may comprise, for example, a raised surface positioned on a support shaft of the lift/lower motor 19, that travels past a fixed lever, causing the lever to raise and thereby break an electrical contact required for the lift/lower motor 19 to operate. Thus, microswitches can be appropriately positioned along the support shaft of the lift/lower motor 19 so as to cause the lift/lower motor 19 to cease lifting or lowering the fixture 11 when the fixture 11 reaches each one of the predetermined elevations A, B and C. The lift/lower motor 19 may then reengage via reset relays as is known in the art. The microswitches are generally represented in FIGS. 1A–B by reference numbers 29*a–d.*

Figure 2:
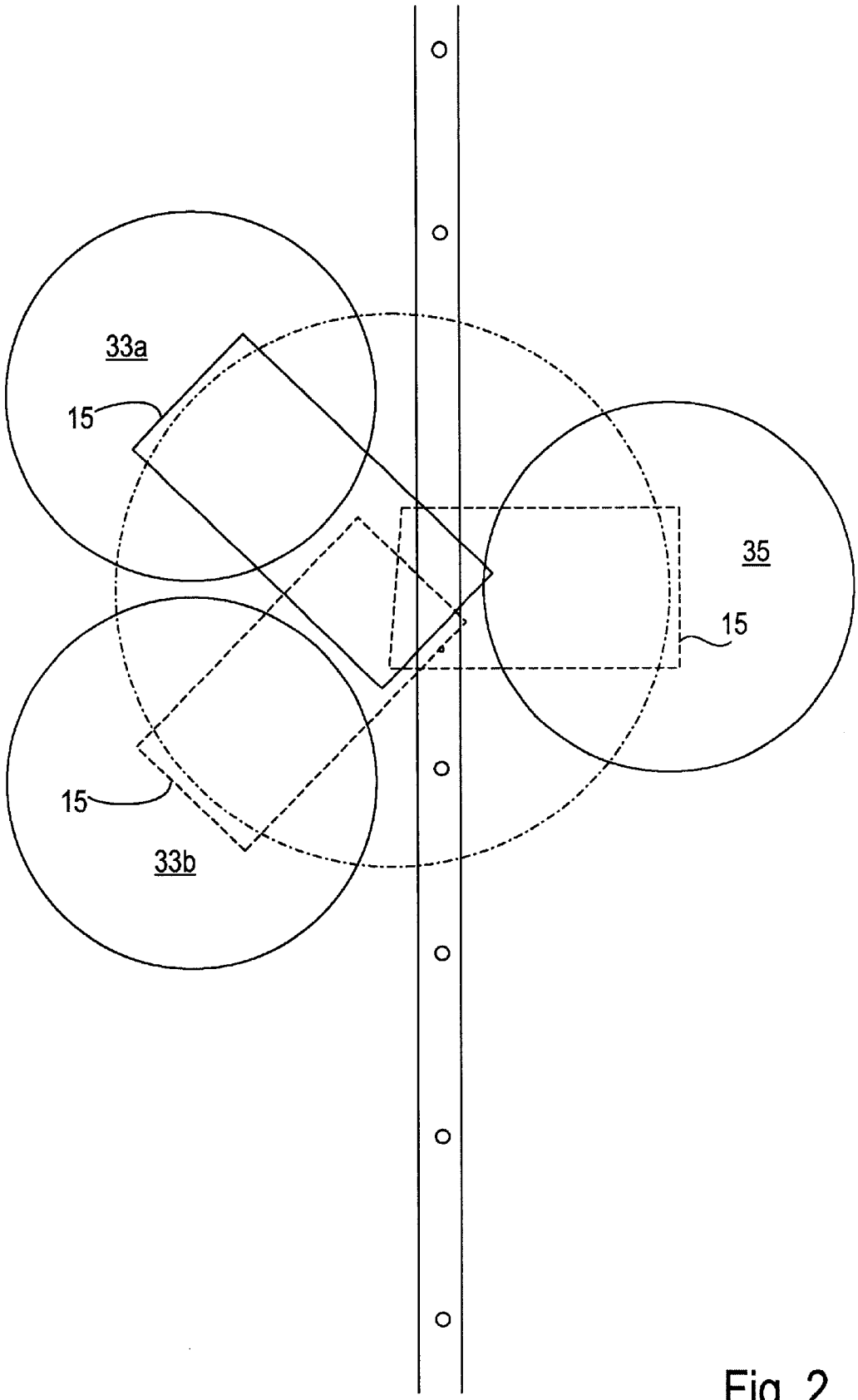
FIG. 2 is a schematic top plan view of an inventive electrochemical deposition system showing a fixture support arm in a first process cell location.

With reference to FIG. 2, a plurality of microswitches, generally represented by reference numbers 31*a–c* are coupled to the rotation motor 21 and appropriately positioned so that rotation of the overhead hoist 15 automatically ceases when the fixture 11 is aligned above a first process cell location 33*a,* a second process cell location 33*b* or a process cell exchange location 35. It will be understood that when the fixture 11 is aligned above one of the process cell locations 33*a–b* or the process cell exchange location 35, the fixture 11 is positioned so that upon lowering to the process cell elevation A, a gripping portion of the fixture 11 will be able to grasp the process cell 13, as described with reference to FIGS. 3A–C.

Figure 3A:
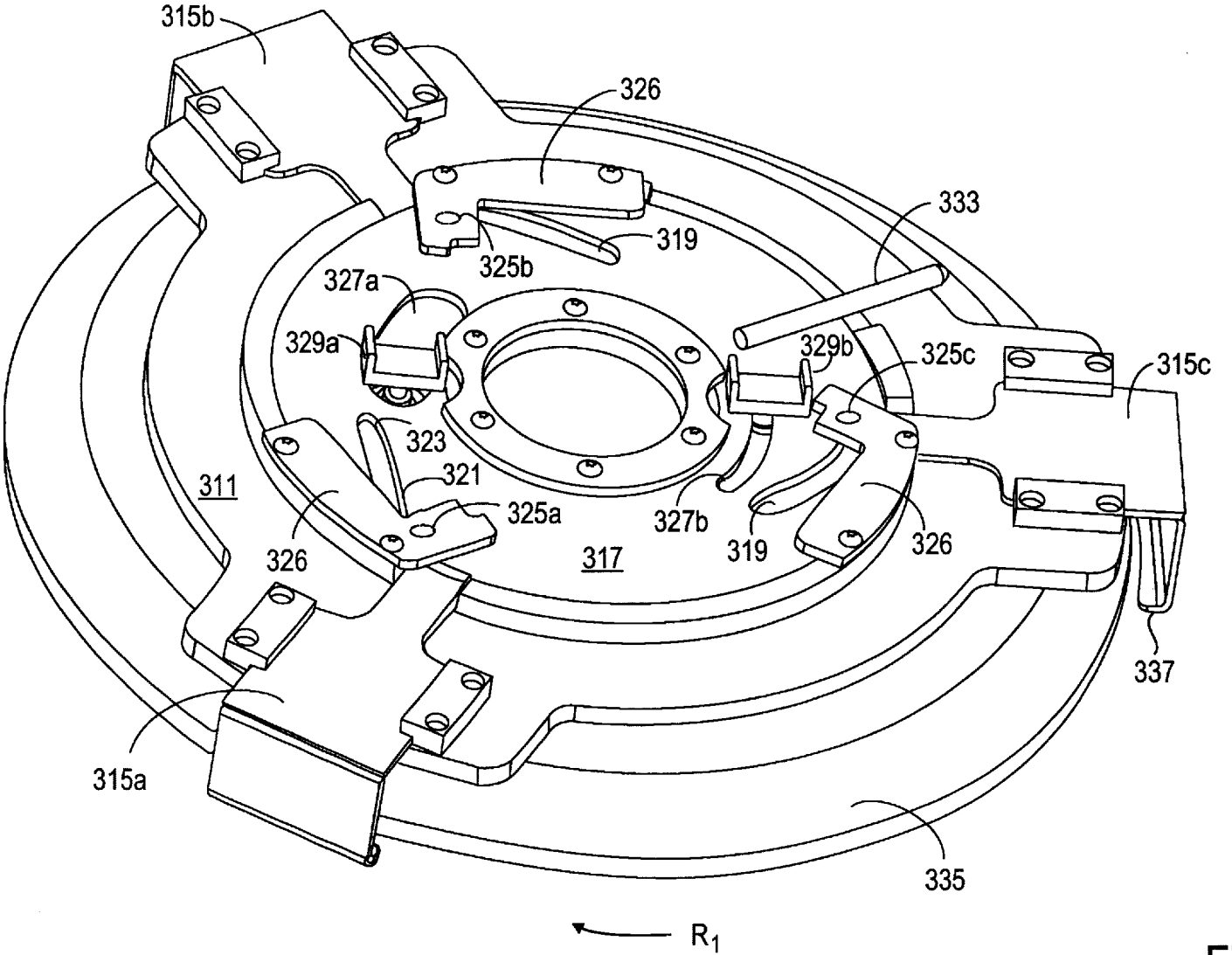
FIGS. 3A and 3B are a top perspective view and a bottom perspective view of a fixture plate showing a gripping portion thereof in an open position.
Figure 3B:
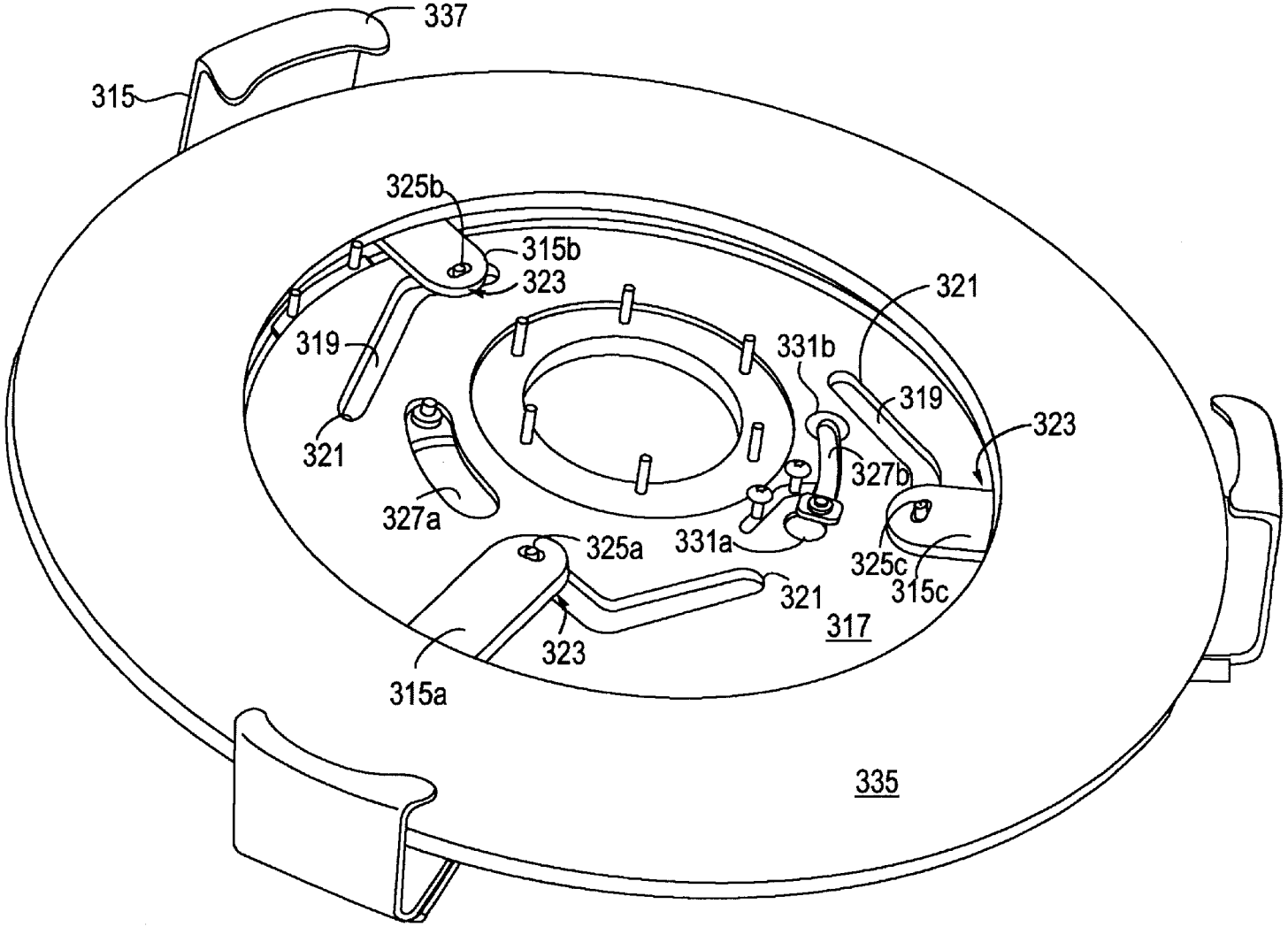
Figure 3C:
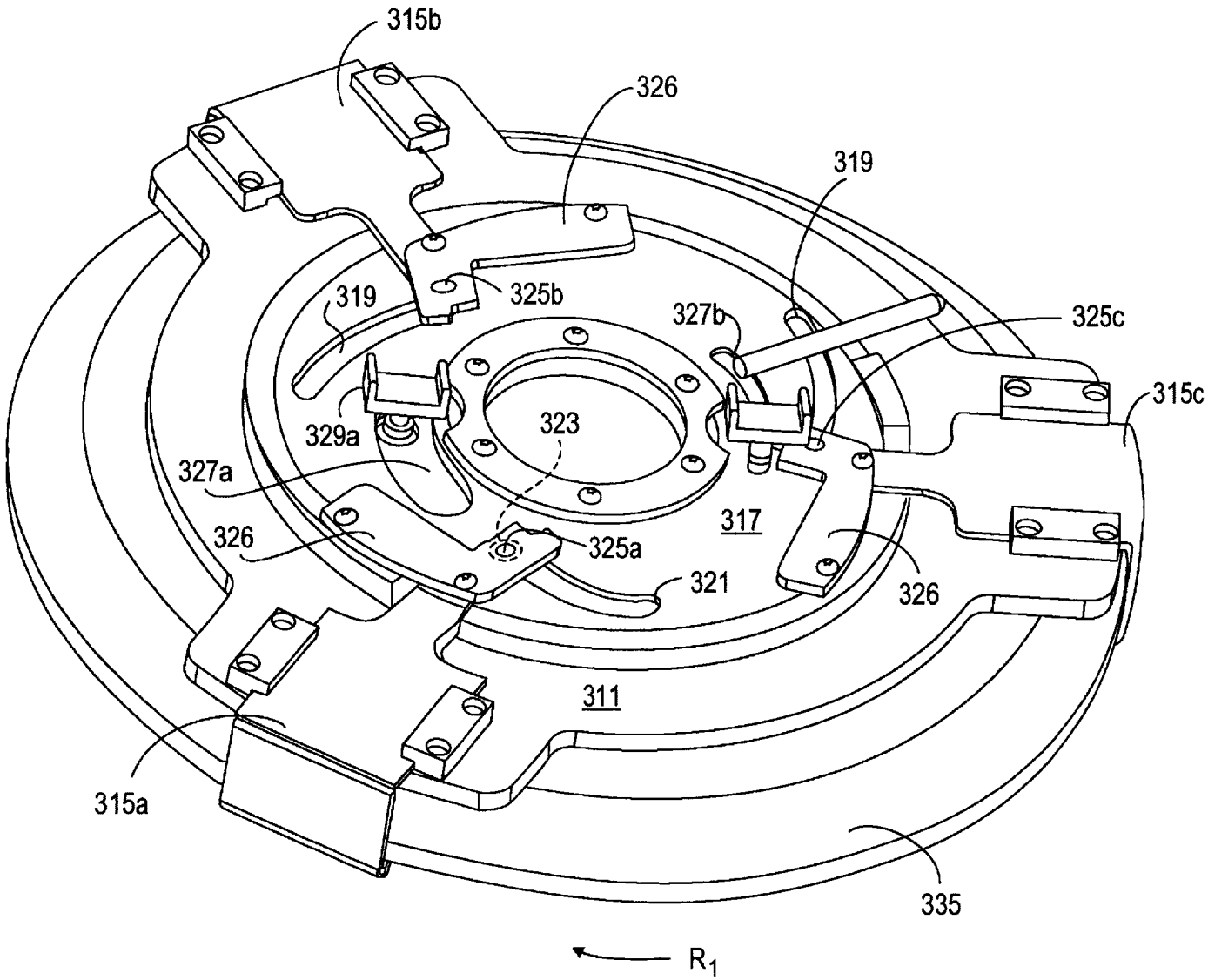
FIG. 3C is a top perspective view of the fixture plate of FIGS. 3A and 3B, showing the gripping portion thereof in a closed position.

FIGS. 3A and 3B are a top perspective view and a bottom perspective view, respectively, of the fixture 11, showing a gripping portion thereof in an open position. The inventive fixture 11 comprises a mounting plate 311 having a plurality of gripping fingers 315*a–c* slidably coupled to the mounting plate 311 so that each finger can extend outwardly from the mounting plate 311 (the "open" position of FIGS. 3A–B) or can retract inwardly toward the mounting plate 311 (the "closed" position of FIG. 3C). To achieve this extension and retraction of the gripping fingers 315*a–c,* the inventive fixture 11 may comprise a rotatable plate 317, having a plurality of concentric slots 319 positioned, one slot 319 adjacent each one of the gripping fingers 315*a–c.* Each concentric slot 319 has an outer end 321, closest to the perimeter of the mounting plate 311, and an inner end 323 closest to the center of the mounting plate 311, and each concentric slot 319 is positioned so as to extend in the direction the mounting plate 311 rotates (e.g., generally perpendicular to the gripping fingers 315*a–c*'s direction of extension and retraction).

A plurality of pins 325*a–c* slidably extend, one through each one of the concentric slots 319*a–c,* and couple to the adjacent gripping finger 315*a–c.* Accordingly, when the rotatable plate 317 rotates in the direction indicated by arrow $R_1$, the pins 325*a–c* slide along the concentric slots 319*a–c* from the outer end 321 toward the inner end 323. Because the pins are coupled to (or are unitary with) the gripping fingers 315*a–c,* the gripping fingers 315*a–c* retract to the closed position as the pins 325 move to the inner end 323 of the concentric slots 319, and extend to the open position as the pins 325*a–c* move to the outer end 321 of the concentric slots 319. The pins 325*a–c* and the slots 319*a–c* therefore create a cam/follower coupling between the gripping fingers 315*a–c* and the rotatable plate 317. A retainer 326 may be coupled to the topside of each pin 325*a–c* to maintain the pin 325*a–c* within the slot 319.

To prevent the rotatable plate 317 from spontaneously rotating and causing the gripping fingers 315*a–c* to release the process cell 13 (FIGS. 1A–B) at an undesirable time, the retractable straps 25*a–b* (FIGS. 1A–B) may be mounted to the rotatable plate 317 in a manner that may selectively lock the rotatable plate 317 in place. Specifically, the rotatable plate 317 may have a pair of concentric slots 327*a–b,* and a pair of hoist mounting brackets 329*a–b* may be slidably coupled to the concentric slots 327*a–b* (e.g., a bolt may extend from the mounting brackets 329*a–b* through the concentric slots 327 and be slidably coupled to the underside of the concentric slots 327 via a nut, as shown in FIG. 3B). The bottom side of one of the concentric slots 327*a–b* (the concentric slot 327*b* as shown in FIG. 3B) may have a recessed region 331*a–b* at each end thereof. Accordingly, when the fixture 11 is suspended by the retractable straps 25*a–b* (FIGS. 1A–B) and the mounting bracket 329*b* (via a nut, etc.) is positioned in one of the recessed regions 331*a–b* the weight of the fixture 11 maintains the mounting bracket 329*b* within the recessed region 331*a–b.* Therefore, unless the load (e.g., the weight of the fixture 11) is removed from the retractable strap 25*b,* the rotatable plate 317 will be locked in place via the upward force of the mounting brackets 329 within the recessed region 331*a–b,* and the gripping fingers 315*a–c* will thus be locked in either the open or closed position. The slot 327*b* may therefore provide rotation control. Further, the bracket 329*b* and/or one or more of the gripping fingers 315*a–c* may be biased toward the closed position by a spring (not shown).

To move the gripping fingers 315*a–c* from the open to the closed position (or vice versa) an operator manually pulls downward on the retractable strap 25*a* to release the load and to lower the mounting bracket 329*a* so that the mounting bracket 329*a* no longer contacts the recessed region 331*a–b.* Thereafter, the operator may manually rotate the rotatable plate 317 by pulling on a handle 333 coupled thereto. The rotatable plate 317 then rotates and the mounting brackets 329*a–b* slide along the concentric slots 327*a–b,* while the pins 325*a–c* coupled to the gripping fingers 315*a–c* slide along the concentric slots 319 causing the gripping fingers 315*a–c* to open or close (depending on the direction of rotation). A process cell 13 (FIGS. 1A–B) may thus be easily grasped or released.

To protect an operator from exposure to harmful chemicals which may accumulate on the surface of the process cell 13 (FIGS. 1A–B) the fixture 11 may also comprise a contamination protection plate 335 coupled to the mounting plate 311 and sized so as to correspond to an upper surface of the process cell 13 to be lifted or lowered by the fixture 11. Further, to deter particle generation the portions of the fixture 11 which make sliding contact may be coated with a particle resistant coating such as Teflon™.

In operation, assuming the overhead hoist 15 is aligned above the process cell exchange location 35, to remove a contaminated process cell 13 from the first process cell location 33*a,* an operator presses a button on a handheld controller (FIG. 1A) that causes the rotation motor 21 to rotate counterclockwise toward the first process cell location 33*a.* When the overhead hoist 15 reaches a position where it is aligned above the first process cell location 33*a,* one of the microswitches 31*a–c* trips, automatically ceasing rotation of the overhead hoist 15. The operator then pushes a button on the handheld controller that causes the lift/lower motor 19 to begin lowering the fixture 11. When the fixture 11 is slightly above the process cell elevation A, the operator may choose to open the gripping fingers 315*a–c*. Accordingly, the operator may stop pushing the button that causes the fixture 11 to lower, and may pull downward on the retractable strap 25*b* that is coupled to the mounting bracket 329*b.* By pulling downward on the retractable strap 25*b,* the load experienced by the mounting bracket 329*b* is lessened, and the mounting bracket 329*b* may exit the recessed region 331*a* (which locks the gripping fingers 315*a–c* in the closed position) and may slide along the recessed region 331. The operator may then cause the rotatable plate 317 to rotate clockwise by grasping the handle 333 (while maintaining the downward force on the retractable strap 25*b*) and pulling the handle 333 in the clockwise direction. As the rotatable plate 317 moves clockwise, the pins 325*a–c* that are coupled to the gripping fingers 315*a–c* move clockwise along the concentric slots 319, from the inner end 323 to the outer end 321, causing the gripping fingers 315*a–c* to move outwardly to the open position. Once the mounting bracket 329*b* has reached the recessed region 331*b,* the gripping fingers 315*a–c* will be in the open position. The operator may then lock the gripping fingers 315*a–c* in the open position by releasing the downward force he has been applying to the retractable strap 25*b,* thus causing the mounting brackets 329 to enter the recessed region 331*a* and be detained thereby.

The operator then may again push the button on the handheld controller that causes the lift/lower motor 19 to lower the fixture 11. By tripping one of the microswitches 29*a–d* the lift/lower motor 19 will automatically stop lowering the fixture 11 when the fixture 11 reaches the process cell elevation A. Thereafter, the operator may rotate the handle 333 counterclockwise, applying downward force to the retractable strap 25*b,* thereby causing the pins 325 to slide along the concentric slots 319 to the inner end 323, and causing the mounting brackets 329*a–b* to slide along the concentric slots 327*a–b* to the recessed region 331*b* of slot 327*b*. Thereafter, the operator releases the downward force applied to the mounting bracket 329*b,* causing the mounting bracket 329*b* to be detained by the recessed region 331*b,* and thus locking the gripping fingers 315*a–c* in the closed position. In the closed position, an inwardly extending lip portion 337 of each of the gripping fingers 315*a–c* may extend beneath an outwardly extending lip portion of the process cell 13 so as to securely grasp the process cell 13. Also, the contamination protection plate 335 extends along the top surface of the process cell 13 so as to cover any contaminants accumulated thereon.

The operator then pushes the button on the handheld controller that causes the lift/lower motor 19 to elevate the fixture 11 to the rotation elevation C. Upon reaching the rotation elevation C, one of the microswitches 29*a–c* will trip, and the lift/lower motor 19 will cease lifting the fixture 11. The operator may then press a button on the controller causing the rotation motor 21 to rotate counterclockwise toward the process cell exchange position 35, where rotation will automatically stop (due to tripping of one of the microswitches 31*a–d*) once the fixture 11 is aligned above the process cell exchange position 35. The fixture may then be lowered and the grippers moved to the open position as previously described. The contaminated process cell 13 then may be removed and a new process cell placed on the process cell exchange location 35 for gripping by the fixture 11. The overhead hoist 15 may rotate from the process cell exchange location 35 in either the clockwise or counterclockwise direction. As generally represented in FIGS. 1A–B, a floating hard stop 26 (e.g., which allows a variability in the degree of rotation from clockwise to counterclockwise rotation) may be coupled to the rotation motor 21 so as to prevent excessive rotation in either direction and thus will prevent the wiring coupled to the overhead hoist 15 from becoming twisted to a harmful extent.

The foregoing description discloses only the preferred embodiments of the invention, modifications of the above disclosed apparatus and method which fall within the scope of the invention will be readily apparent to those of ordinary skill in the art. For instance, the specific number and configuration of parts may vary and still provide the intended function. Further, the term used herein to describe parts is not intended to be limiting, accordingly items referred to as a "plate" or a "pin" are not to be limited to any particular shape.

Accordingly, while the present invention has been disclosed in connection with the preferred embodiments thereof, it should be understood that other embodiments may fall within the spirit and scope of the invention, as defined by the following claims.

What is claimed is:

1. A fixture adapted to selectively grasp and release an object to be lifted, comprising:

a mounting plate;

a plurality of gripper fingers slidably coupled to the mounting plate so that each gripper finger can extend outwardly, and retract inwardly;

a rotatable plate rotatably coupled to the mounting plate, and having a plurality of slots, each slot being positioned adjacent one of the plurality of gripper fingers, and each slot having an outer end and an inner end positioned such that the slot extends in the direction the rotatable plate rotates;

a plurality of pins each pin slidably extending through one of the plurality of slots and coupling to one of the gripper fingers.

2. The fixture of claim 1 wherein the gripper fingers are adapted to grasp an object positioned below the fixture and wherein the rotatable plate further comprises a pair of mounting brackets adapted to couple to a pair of straps extending from an overhead hoist.

3. The fixture of claim 1 wherein the rotatable plate further comprises a rotation control slot that extends in the rotatable plate's direction of rotation, and wherein one of the pair of mounting brackets is slidably coupled to the rotation control slot.

4. The fixture of claim 3 further comprising a recessed region on the bottom side of the rotation control slot, and wherein the mounting bracket slidably coupled to the rotation control slot is adapted so as to be detained by the recessed region.

5. The fixture of claim 4 further comprising a particle resistant coating formed over any surface where sliding contact occurs.

6. The fixture of claim 1 further comprising a contamination protection plate, coupled to the mounting plate and sized so as to correspond to an upper surface of the object to be lifted.

7. An electrochemical deposition system, comprising:

a first electrochemical process cell location;

an overhead hoist positioned above the electrochemical process cell location, comprising the fixture of claim 2;

a motor adapted to lift and lower the fixture; and a pair of retractable straps coupled to the motor and to the fixture.

8. The system of claim 7 further comprising:

a process cell exchange location;

a rotatable support arm, from which the straps may extend and retract, and a motor adapted to rotate the rotatable support arm between a position above the first electrochemical process cell location and a position above the process cell exchange location.

9. The system of claim 8 further comprising:

a plurality of switches coupled to the rotation motor and adapted to automatically stop the fixture when the fixture reaches the position above the first electrochemical process cell location and when the fixture reaches the position above the process cell exchange location.

10. The system of claim 9 further comprising:

a plurality of switches coupled to the lifting/lowering motor and adapted to automatically stop the fixture plate when the fixture plate reaches an elevation of the process cell location, and to stop the fixture plate when the fixture plate is at an elevated, rotation position, wherein the retractable straps are primarily retracted.

11. The system of claim 10 further comprising a lock out mechanism adapted to ensure that only one of the lift/lower motor and the rotation motor operates at a given time.

12. The system of claim 8 further comprising a lock out mechanism adapted to ensure that only one of the lift/lower motor and the rotation motor operates at a given time.

13. The system of claim 8 further comprising a second electrochemical process cell location, wherein the motor adapted to rotate the rotatable support arm is further adapted to rotate the rotatable support arm to a position above the second electrochemical process cell location.

14. The system of claim 13 further comprising:

a plurality of switches coupled to the rotation motor and adapted to automatically stop the fixture plate when the fixture reaches the position above the first process cell location, the position above the second process cell location and the position above the process cell exchange location.

15. The system of claim 13 further comprising a mechanism adapted to prevent excessive rotation.

16. The system of claim 7 further comprising:

a plurality of switches coupled to the lifting/lowering motor and adapted to automatically stop the fixture when the fixture reaches an elevation of the process cell location, and to stop the fixture when the fixture is at an elevated, rotation position, wherein the retractable straps are primarily retracted.

17. An electrochemical deposition system comprising:

a fixture adapted to selectively grasp and release an electrochemical process cell;

a lift/lower mechanism coupled to the fixture and adapted to automatically stop lowering the fixture at a process cell elevation;

a rotation mechanism coupled to the fixture and adapted to automatically stop rotating the fixture when aligned with a process cell location and when aligned with a process cell exchange location.

18. The system of claim 17 wherein the lift/lower mechanism is adapted to automatically stop elevating the fixture at a rotation elevation.

19. The system of claim 17 wherein the fixture comprises a gripping mechanism adapted to selectively grip and release a process cell, and adapted to lock in a gripping position.

20. The system of claim 17 further comprising a handheld controller adapted to allow an operator to remotely control the operation of the lift/lower mechanism and of the rotation mechanism.

21. A method of installing or removing an electrochemical process cell comprising:

rotating a fixture into alignment above a process cell location;

lowering the fixture to a process cell elevation;

grasping a process cell with the fixture;

locking the fixture to the process cell; and lifting the fixture and the process cell locked thereto;

wherein rotating, lowering and lifting occur via remote control.

22. The method of claim 21 further comprising preventing rotation during lifting and lowering.

23. The method of claim 21 further comprising automatically ceasing lowering of the fixture at the process cell elevation.

24. The method of claim 23 further comprising automatically ceasing lifting of the fixture at a rotation elevation wherein the mechanism employed to lower the fixture is substantially retracted.

25. The method of claim 21 further comprising:

rotating the lifted fixture to a process cell exchange location via remote control.

26. The method of claim 25 further comprising automatically ceasing rotation of the lifted fixture when the fixture is aligned above the process cell exchange location.

27. The method of claim 21 further comprising automatically ceasing rotation of the fixture when the fixture is aligned above the process cell location.

28. The method of claim 26 further comprising automatically ceasing rotation of the fixture when the fixture is aligned above the process cell exchange location.

29. The method of claim 21 wherein grasping the process cell with the fixture comprises rotating a portion of the fixture so as to retract a gripping portion of the fixture.

30. The method of claim 29 wherein rotating a portion of the fixture activates a cam/follower coupling between the rotating portion and the gripping portion, so as to retract the gripping portion.

31. The method of claim 30 wherein the fixture is lifted and lowered via a plurality of straps that are coupled to the rotating portion of the fixture; and wherein rotating a portion of the fixture comprises reducing a load experienced by one of the straps prior to rotating the portion of the fixture.

32. The method of claim 31 wherein reducing the load experienced by one of the straps comprises pulling downwardly on the one strap such that the other strap carries a greater portion of the fixture's weight, and wherein locking the fixture to the process cell comprises releasing the downward force applied to the one strap, after the one strap has moved into a detention area.

* * * * *